US005888107A

United States Patent [19]

Seymour et al.

[11] Patent Number: 5,888,107

[45] Date of Patent: Mar. 30, 1999

[54] MALE CONTACT

[75] Inventors: Douglas G. Seymour, Lakewood, N.Y.; Richard P. Walker, Saegertown, Pa.

[73] Assignee: Osram Sylvania Inc., Danvers, Mass.

[21] Appl. No.: 64,407

[22] Filed: Apr. 22, 1998

[51] Int. Cl.[6] ..... H01R 9/24

[52] U.S. Cl. ..... 439/891; 439/866

[58] Field of Search ..... 439/176, 219, 439/221, 481, 482, 865, 866, 877, 882, 884, 891

[56] References Cited

U.S. PATENT DOCUMENTS

| | | | |
|---|---|---|---|
| 4,010,993 | 3/1977 | Hohenberger et al. | 439/176 |
| 5,487,686 | 1/1996 | Sawada | 439/884 |

*Primary Examiner*—Steven L. Stephan
*Assistant Examiner*—Brian J. Biggi
*Attorney, Agent, or Firm*—William H. McNeill

[57] ABSTRACT

A two piece male contact, such as a harness contact for use in a harness connector. The two piece male contact includes an elongated contact pin which is connectable to a mating female contact, and a terminal, one end of which is electrically and mechanically attached to the contact pin and the other end of which is connectable to a conductor.

18 Claims, 4 Drawing Sheets

MALE CONTACT

TECHNICAL FIELD

The present invention relates to a male contact which may be connected to a female contact to provide an electrical and mechanical connection between the two. Without limitation, the male contact of the present invention is particularly suited as a harness contact in a connector useful in a wiring harness in an automotive electrical system.

BACKGROUND ART

A typical connector such as a harness connector for use in the automobile industry includes a male harness connector and a female harness connector. Typically, the male harness connector includes a plurality of contact pins and the female harness connector includes a plurality of ferrules in the form of sockets which mate with respective contact pins. In use, the male contact pins are plugged into the female sockets to effect a mechanical and electrical connection between the two. Typically, a plurality of cables such as coaxial cables are electrically and mechanically attached to respective contacts of one of the harness connectors such as the contact pins of the male connector. Similarly, a plurality of coaxial cables is typically electrically and mechanically attached to respective contacts of the other connector, such as the ferrules of the female connector. The cables may be attached to the respective contacts by crimping and/or welding in a conventional manner.

In such an application there is a need for providing a satisfactory male contact pin which exhibits adequate strength and conductivity. There is also a need for providing a pin terminal which exhibits adequate conductivity, and satisfactory strength and ductility for electrical and mechanical crimped connection between a conductor and the terminal.

When fabricating male contacts such as, for example, pin-type contacts for use in a pin-type harness connector, it is known to use a dual gauged material to form a contact terminal, for attachment to a conductor such as a coaxial cable, and a pin extending from the terminal. Such material provides satisfactory ductility for crimping connectors to the conductor and satisfactory strength and conductivity. However, the use of dual gauged material is much more costly than single gauged material. It is also known to use single gauged material which is folded to provide contact pins having a 0.64 mm terminal interface. However, it is inherent in such a configuration that contact pins fabricated from folded material are limited to two sided matability. In addition, there are strength concerns in such applications.

DISCLOSURE OF THE INVENTION

It is an object of the present invention to provide an improved male contact.

It is a further object of the present invention to provide an improved male contact particularly suited as a harness contact in a harness connector.

It is another object of the present invention to provide a male contact which provides material and geometry optimization in the construction thereof.

Yet another object of the present invention is to provide a two piece male contact having satisfactory conductivity, ductility and strength.

A further object of the present invention is to provide such a male harness contact which is less costly than those manufactured heretofore.

Another object of the present invention is to provide a two piece male harness contact which includes a solid contact pin having satisfactory strength and conductivity and a contact terminal having satisfactory ductility, strength and conductivity.

This invention achieves these and other results by providing a two piece male contact, comprising an elongated contact pin attached to an elongated terminal. The elongated contact pin extends in the direction of a longitudinal axis from a first end to an opposite second end, the pin having oppoiste first and second surface areas, and opposite third and fourth surface areas, which extend in such direction. The elongated terminal extends in such direction from one end to an opposite end. The terminal comprises (a) a first segment adjacent the one end of the terminal, the first segment including a first pair of opposing jaws engaging the first and second surface areas of the pin, and a second pair of opposing jaws engaging the third and fourth surface areas of the pin; (b) a second segment extending from the first segment and including a first section having a first contact area engaging the first surface area of the pin and an opposite second section having a second contact area engaging the second surface area of the pin; (c) a third segment positioned between the second segment and the other end of the terminal, the third segment including a first region engaging the first surface area of the pin and an opposite second region engaging the second surface area of the pin; and (d) a fourth segment positioned between the third segment and the other end of the terminal and constructed and arranged for electrical and mechanical connection to a conductor.

BRIEF DESCRIPTION OF THE DRAWINGS

This invention may be clearly understood by reference to the attached drawings wherein like elements are designated by like reference numerals and in which.

BEST MODE FOR CARRYING OUT THE INVENTION

For a better understanding of the present invention, together with other and further objects, advantages and capabilities thereof, reference is made to the following specification and claims taken in conjunction with the above-described drawings.

Figure 1:
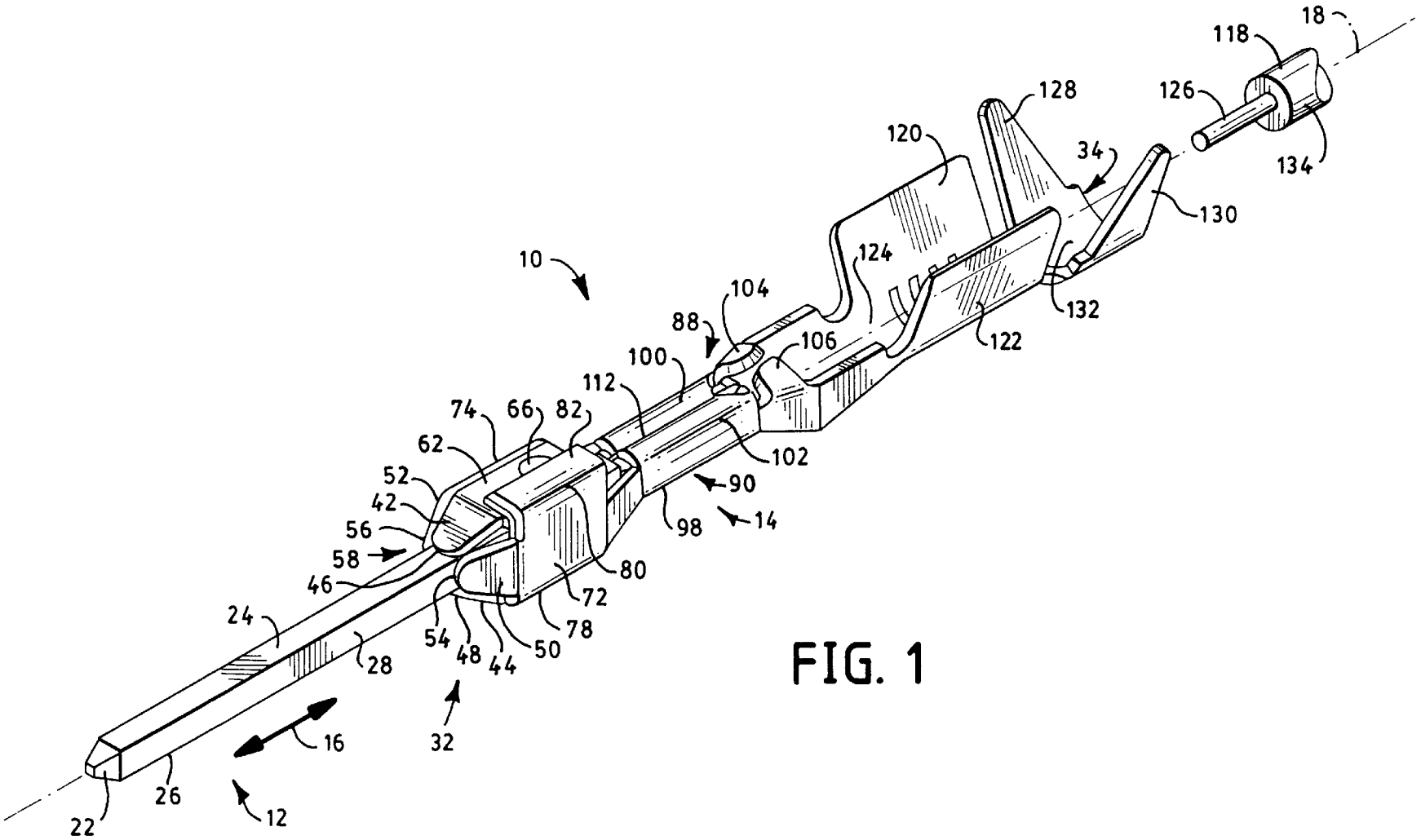
FIG. 1 is a perspective view of a male contact of the present invention and a conductor for connection thereto.
Figure 2:
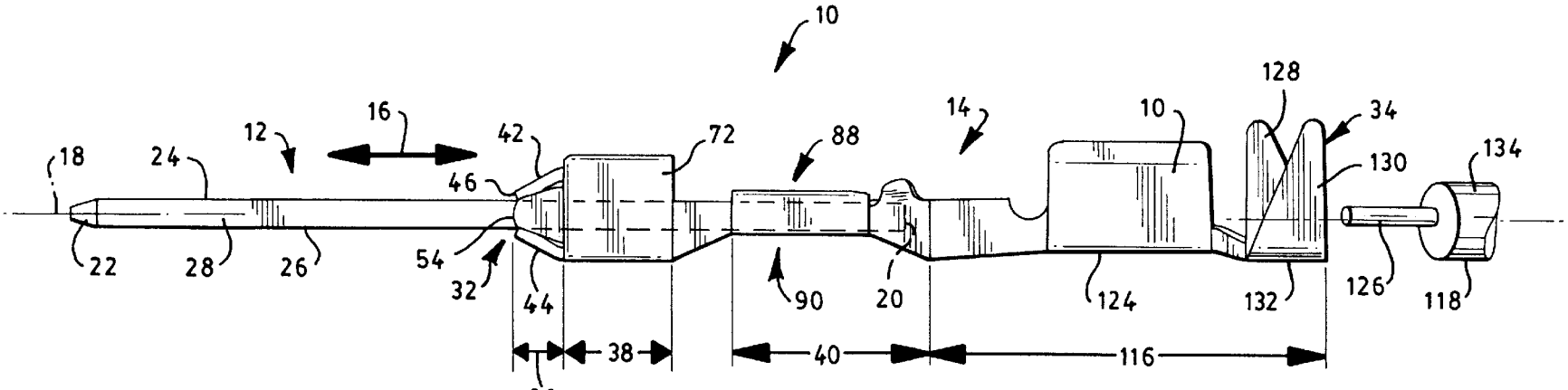
FIG. 2 is an elevational view of the male contact of FIG. 1.
Figure 3:
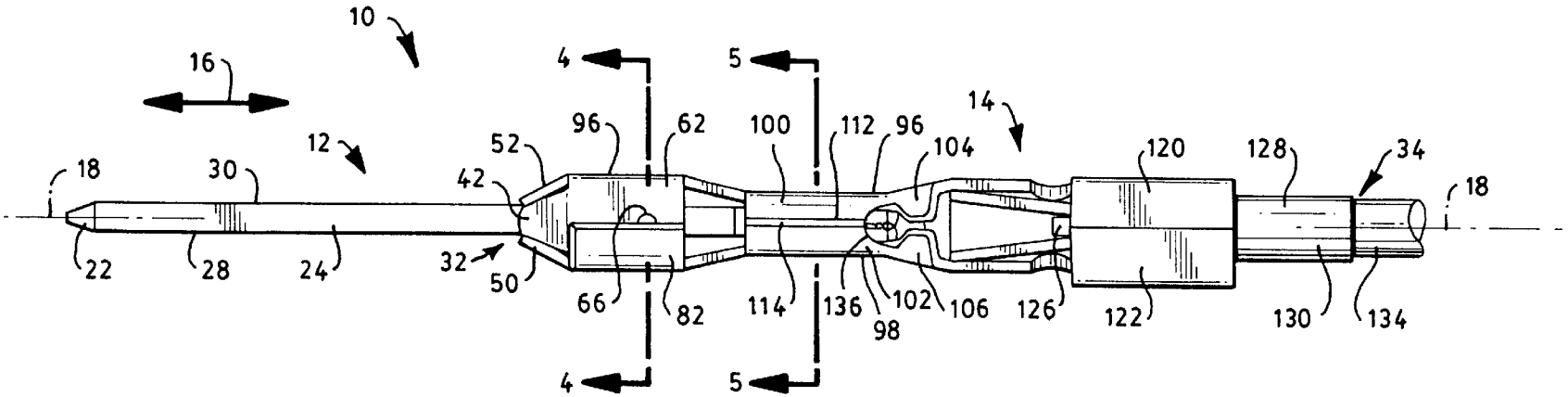
FIG. 3 is a plan view of the male contact of FIG. 1 illustrating a conductor connected to the male contact.

The embodiment of this invention which is illustrated in the drawings is particularly suited for achieving the objects of this invention. FIGS. 1 to 3 illustrate a male contact 10 which comprises an elongated contact pin 12 and an elongated terminal 14. Without limitation, male contact 10 is useful as a harness contact in a harness connector in an automobile. Pin 12 extends in the direction 16 of a longitudinal axis 18 from a first end 20 to an opposite second end 22 as best illustrated in FIG. 2.

The pin 12 includes a first surface area 24 and an opposite second surface area 26, and a third surface area 28 and an opposite fourth surface area 30. Surface areas 24, 26, 28 and 30 extend in direction 16 from end 20 to end 22. In the embodiment of FIGS. 1 to 3, end 22 is a truncated pyramid for ease of insertion into a mating female contact. In the embodiment of FIGS. 1 to 3, the length of the contact pin 12 to be inserted into a mating female contact may have a square cross-sectional configuration when viewed in the direction 16 of axis 18 and may have a thickness of about 0.64 mm. In the embodiment illustrated in the drawings, contact pin 12 is solid.

Figure 4:
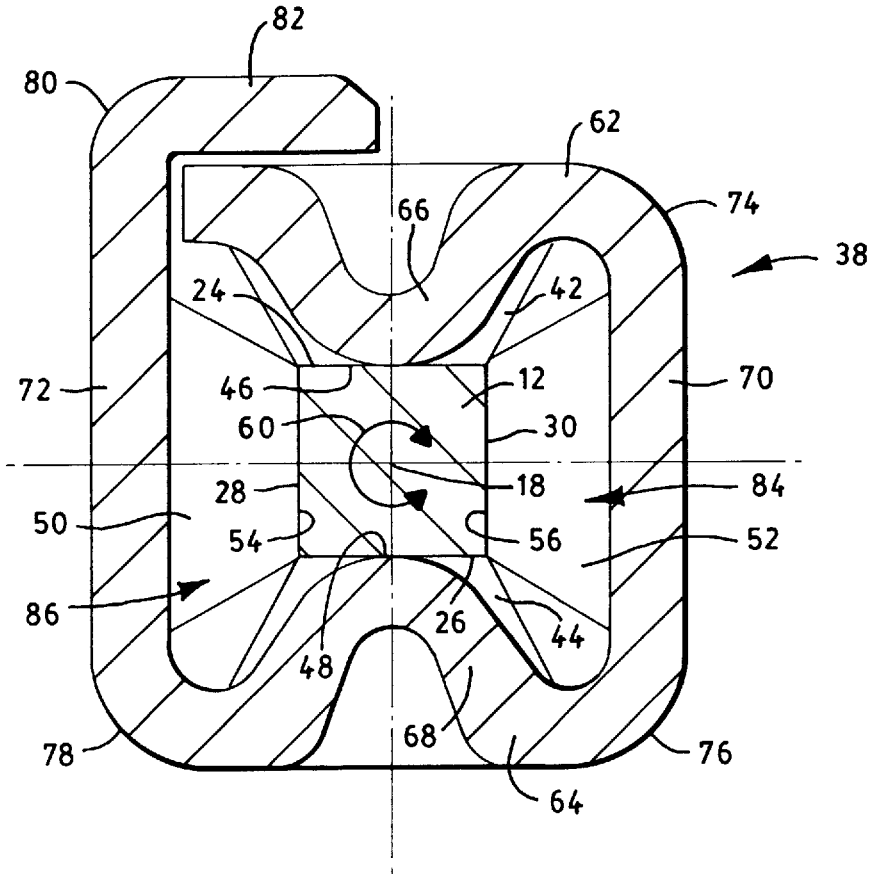
FIG. 4 is a cross sectional view taken along lines 4—4 of FIG. 3.

Terminal 14 extends in direction 16 from one end 32 to another end 34. The pin 12 is attached to the terminal 14 as described herein. For example, with reference to FIG. 2, terminal 14 includes a first segment 36, second segment 38 and third segment 40. Segment 36 is adjacent the end 32 of terminal 14 and includes a first pair of opposing jaws which engage two of the opposing surfaces of the pin 12 and a second pair of opposing jaws which engage two other opposing surfaces of the pin 12. In particular, in the embodiment illustrated in FIGS. 1 to 4, a first pair of opposing jaws is illustrated which includes a first jaw 42 and an opposite second jaw 44. Jaws 42 and 44 extend towards axis 18 from the second segment 38 to a respective first distal jaw end 46 and second distal jaw end 48. Similarly, a second pair of opposing jaws is illustrated which includes a third jaw 50 and an opposite fourth jaw 52. Jaws 50 and 52 extend towards axis 18 from the second segment 38 to a respective third distal jaw end 54 and fourth distal jaw end 56. The distal jaw ends 46, 48, 54 and 56 engage, respectively, the surface areas 24, 26, 28 and 30 of the contact pin 12 as best illustrated in FIG. 4. In assembling the male contact 10 of the present invention, the contact pin 12 may be inserted into the terminal 14 at an opening 58 formed by the distal jaw ends 46, 48, 54 and 56, and when the male contact is formed in this manner the distal jaw ends serve to facilitate such insertion. The four jaws 42, 44, 50 and 52 provide four sided mating with contact pin 12. In the embodiment illustrated in the drawings, the jaws 42, 44, 50 and 52 are equally spaced from each other in a direction 60 which extends circumferentially about axis 18 as best illustrated in FIG. 4.

Segment 38 of the terminal 14 extends from segment 36 towards terminal end 34. Segment 38 includes a first section having a first contact area which engages one surface area of the contact pin 12, and an opposite second section having a second contact area which engages an opposite surface area of the contact pin. For example, in the embodiment illustrated in FIGS. 1 to 4, segment 38 includes a first section 62 having a first contact area which engages surface area 24 of contact pin 12 and a second section 64 having a second contact area which engages surface area 26 of the contact pin. In the embodiment illustrated in FIG. 4, the contact area of first section 62 includes a first intermediate indentation 66, and the contact area of second section 64 includes a second intermediate indentation 68, indentations 66 and 68 engaging surface areas 24 and 26, respectively, of contact pin 12. The indentations 66 and 68 serve to facilitate the correct positioning of the contact pin 12 within the terminal 14, the indentations contacting the opposing two surface areas 24 and 26.

In the embodiment illustrated in FIGS. 1 to 4, the segment 38 includes a third section 70 and an opposite fourth section 72. Section 70 is integral with and extends between a first edge 74 of the section 62 and a first edge 76 of the section 64. The section 72 is integral with and extends from a second edge 78 of the section 64. The section 72 extends towards a second edge 80 of the section 62 and includes a distal component 82 which is folded about edge 80 and lies in a plane adjacent the section 62 as best illustrated in FIG. 4. The female contact (not shown) with which male contact 10 is to be mated may be configured to mate with the distal component 82 as the male contact is inserted into the female contact to provide improved keying between male and female contacts. In the embodiment illustrated in FIG. 4, the section 70 and the section 72 are spaced from the contact pin 12 at 84 and 86, respectively.

Segment 40 of the terminal 14 is positioned between segment 38 and the end 34 of the terminal. Segment 40 includes a first region which engages one surface area of the contact pin 12 and an opposite second region which engages another surface area of the contact pin. For example, in the embodiment illustrated in FIGS. 1 to 3 and 5, segment 40 includes a first region 88 which engages surface area 24 of the contact pin 12 and an opposite second region 90 which engages surface area 26 of the contact pin.

Figure 5:
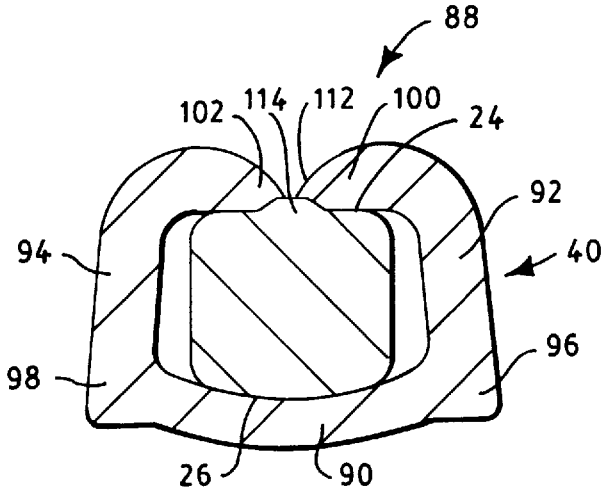
FIG. 5 is a cross sectional view taken along lines 5—5 of FIG. 3.
Figure 6:
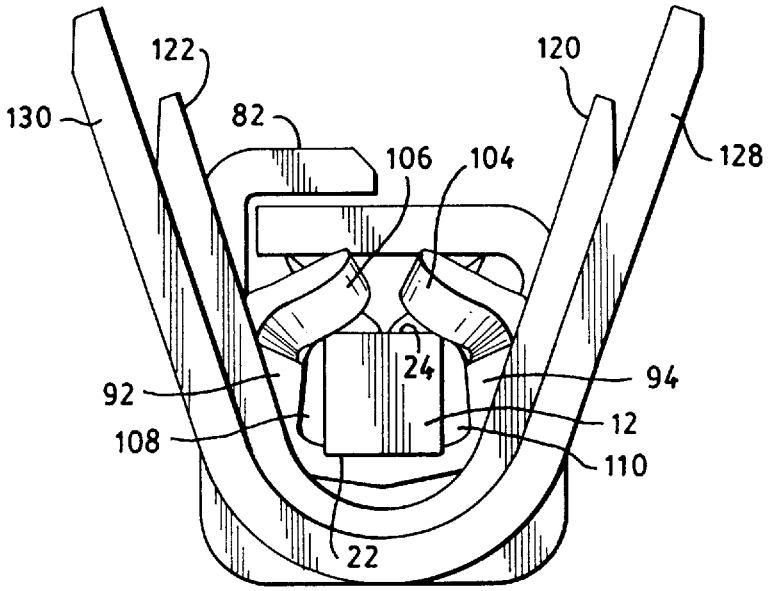
FIG. 6 is an end view of the male contact of the present invention viewed from the right (end 34) of FIG. 2.

In the embodiment illustrated in FIGS. 1 to 3 and 5, segment 40 includes a third region 92 and an opposite fourth region 94. Regions 92 and 94 are integral with and extend from a first length 96, and an opposite second length 98, of region 90. Region 88 includes a leg 100 which extends from region 92 towards region 94, and another leg 102 which extends from region 94 towards region 92. Legs 100 and 102 engage the surface 24 of the contact pin 12 as best illustrated in FIG. 5. With reference to FIGS. 1 to 3 and 6, region 40 also includes a leg 104 which extends from region 94 towards region 92, and a leg 106 which extends from region 92 towards region 94. Legs 104 and 106 engage surface 24 of the contact pin 12 as best illustrated in FIG. 1 and FIG. 6. In the embodiment of FIG. 6, the region 92 and the region 94 are spaced from the contact pin 12 at 108 and 110, respectively.

In considering the legs 100 and 102 of the region 88, a distal end of leg 100 is spaced from a distal end of leg 102 to provide a gap 112 between legs 100 and 102 as illustrated in FIG. 5. The gap 112 extends in direction 16. Contact pin 12 includes an elongated protrusion 114 which protrudes into the gap 112. Such a configuration serves to facilitate the prevention of rotation of the contact pin 12 about its axis 18 after the pin is attached to terminal 14. Jaws 42, 44 50 and 52 also facilitate the prevention of such rotation. The gripping of the contact pin 12 by protrusions 66 and 68; terminal regions 88 and 90; and legs 104 and 106, attaches the pin to the terminal and prevents axial movement of the pin relative to the terminal in the direction 16.

The male contact 10 of the present invention includes a fourth segment 116 located between the third segment 40 and the end 34 of the terminal 14. The segment 40 is constructed and arranged for electrical and mechanical connection to a conductor 118. For example, the segment 40 may include a first pair of opposing resilient wings 120 and 122 located between the segment 40 and end 34 of the terminal 14. Wings 120 and 122 extend from opposite sides of a first base length 124 of terminal 14. Conductor 118 may be positioned within terminal 14 adjacent end 34 such that a conductive length of conductor 118, such as a central wire 126 of conductor 118 engages base length 124 as illustrated in FIG. 3. Subsequently, the resilient wings 120 and 122 may be crimped against the central wire 126 in order to mechanically and electrically connect the central wire 126 to the terminal 14.

The segment 40 also may include a second pair of opposing resilient wings 128 and 130 located between wings 120, 122 and end 34 of the terminal 14. Wings 128 and 130 extend from opposite sides of a second base length 132 of terminal 14. In this embodiment, when conductor 18 is positioned within terminal 14 such that the length of central conductor 126 engages the base length 124, an insulative length of the conductor 118, such as a jacketed length 134 of the conductor 118, engages base length 132 as illustrated in FIG. 3. Subsequently, the resilent wings 128 and 130 may be crimped against the jacketed length 134 in order to mechanically connect the jacketed length to the terminal 14. In the embodiment illustrated in FIG. 2, the base length 124 and the base length 132 are substantially parallel to axis 18, the radial distance between axis 18 and base length 132 being greater than the radial distance between axis 18 of base length 124. Such dimensional configuration permits the conductor 118 to be inserted into the terminal 14 at end 34 such that the central wire 126 and jacketed length 134 extend in direction 16 of axis 18 such that substantively the full length of the central wire and jacketed length engage base lengths 124 and 132, respectively.

In the embodiment illustrated in the drawings, the connection between the contact pin 12 and terminal 14 may be further facilitated by, for example, welding at 136.

The two piece male contact of the present invention provides optimization of material and geometry in the construction of a male contact. For example, male contact 10 may include a solid contact pin 12 having the conductivity and strength required for use as a harness contact in a harness connector. In addition, the male contact 10 may include a terminal having the required conductivity for use in a harness connector yet have the required strength and ductility for the crimped connection of the harness terminal to a conductor. The cost of fabricating the male contact of the present invention can be reduced by selecting one material for the solid contact pin, such material having the required high conductivity and high strength, and another material for the terminal, such material having the required high conductivity and strength, and yet having the required ductility for attachment to a conductor.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

What is claimed is:

1. A male contact, comprising:

an elongated contact pin extending in the direction of a longitudinal axis from a first end to an opposite second end, said pin having opposite first and second surface areas, and opposite third and fourth surface areas, which extend in said direction; and an elongated terminal extending in said direction from one end to another end, said pin being attached to said terminal; said terminal comprising (a) a first segment adjacent said one end, said first segment including a first pair of opposing jaws engaging said first and second surface areas and a second pair of opposing jaws engaging said third and fourth surface areas; (b) a second segment extending from said first segment and including a first section having a first contact area engaging said first surface area and an opposite second section having a second contact area engaging said second surface area; (c) a third segment positioned between said second segment and said another end of said terminal, said third segment including a first region engaging said first surface area and an opposite second region engaging said second surface area; and (d) a fourth segment positioned between said third segment and said another end and constructed and arranged for electrical and mechanical connection to a conductor.

2. The male contact of claim 1 wherein said first pair of opposing jaws includes a first jaw and an opposite second jaw each of which extends towards said longitudinal axis from said second segment to a respective first distal jaw end and second distal jaw end, and said second pair of opposing jaws includes a third jaw and an opposite fourth jaw each of which extends towards said longitudinal axis from said second segment to a respective third distal jaw end and fourth distal jaw end, said first, second, third and fourth distal jaw ends engaging, respectively, said first, second, third and fourth surface areas.

3. The male contact of claim 1 wherein said first, second, third and fourth jaws are equally spaced from each other in a direction which extends circumferentially about said longitudinal axis.

4. The male contact of claim 1 wherein said second segment includes a third section and an opposite fourth section, said third section being integral with and extending between a first edge of said first section, and a first edge of said second section, and said fourth section being integral with and extending from a second edge of said second section, said fourth section extending towards a second edge of said first section and having a distal component which is folded about said second edge of said first section and lies in a plane adjacent said first section.

5. The male contact of claim 4 wherein said third section and said fourth section are spaced from said contact pin.

6. The male contact of claim 1 wherein said first section includes a first intermediate indentation and said second section includes a second intermediate indentation, said first indentation and said second indentation comprise said first contact area and said second contact area, respectively.

7. The male contact of claim 6 wherein said second segment includes a third section and an opposite fourth section, said third section being integral with and extending between a first edge of said first section, and a first edge of said second section, and said fourth section being integral with and extending from a second edge of said second section, said fourth section extending towards a second edge of said first section and having a distal component which is folded about said second edge of said first section and lies in a plane adjacent said first section.

8. The male contact of claim 7 wherein said first pair of opposing jaws includes a first jaw and an opposite second jaw each of which extends towards said longitudinal axis from said second segment to a respective first distal jaw end and second distal jaw end, and said second pair of opposing jaws includes a third jaw and an opposite fourth jaw each of which extends towards said longitudinal axis from said second segment to a respective third distal jaw end and fourth distal jaw end, said first, second, third and fourth distal jaw ends engaging, respectively, said first, second, third and fourth surface areas.

9. The male contact of claim 8 wherein said first, second, third and fourth jaws are equally spaced from each other in a direction which extends circumferentially about said longitudinal axis.

10. The male contact of claim 9 wherein said third segment includes a third region and an opposite fourth region, said third region and said fourth region being integral with and extending from, respectively, a first length of said second region and an opposite second length of said second region, said first region including (a) a first leg, and a second leg, extending from said third region towards said fourth region, and (b) a third leg, and fourth leg, extending from said fourth region towards said third region, said first, second, third and fourth legs engaging said first surface area.

11. The male contact of claim 10 wherein a distal leg end of said first leg is spaced from a distal length end of said third leg to provide a gap between said first leg and said third leg, said gap extending in said direction, and said contact pin includes an elongated protrusion which protrudes into said gap.

12. The male contact of claim 11 wherein said third region and said fourth region are spaced from said contact pin, a distal leg end of said first leg is spaced from a distal length end of said third leg to provide a gap between said first leg and said third leg, said gap extending in said direction, and said contact pin includes an elongated protrusion which protrudes into said gap.

13. The male contact of claim 12 wherein said fourth segment comprises a first pair of opposing resilient wings positioned between said third segment and said another end of said terminal and constructed and arranged for mechanical and electrical connection to a conductive length of a conductor, and a second pair of opposing resilient wings positioned between said first pair of wings and said another end and constructed and arranged for mechanical connection to an insulative length of said conductor.

14. The male contact of claim 9 wherein said fourth segment comprises a first pair of opposing resilient wings positioned between said third segment and said another end of said terminal and constructed and arranged for mechanical and electrical connection to a conductive length of a conductor, and a second pair of opposing resilient wings positioned between said first pair of wings and said another end and constructed and arranged for mechanical connection to an insulative length of said conductor.

15. The male contact of claim 1 wherein said third segment includes a third region and an opposite fourth region, said third region and said fourth region being integral with and extending from, respectively, a first length of said second region and an opposite second length of said second region, said first region including (a) a first leg, and a second leg, extending from said third region towards said fourth region, and (b) a third leg, and fourth leg, extending from said fourth region towards said third region, said first, second, third and fourth legs engaging said first surface area.

16. The male contact of claim 15 wherein said third region and said fourth region are spaced from said contact pin.

17. The male contact of claim 15 wherein a distal leg end of said first leg is spaced from a distal length end of said third leg to provide a gap between said first leg and said third leg, said gap extending in said direction, and said contact pin includes an elongated protrusion which protrudes into said gap.

18. The male contact of claim 1 wherein said fourth segment comprises a first pair of opposing resilient wings positioned between said third segment and said another end of said terminal and constructed and arranged for mechanical and electrical connection to a conductive length of a conductor, and a second pair of opposing resilient wings positioned between said first pair of wings and said another end and constructed and arranged for mechanical connection to an insulative length of said conductor.

* * * * *